US006132247A

United States Patent [19]

Liou et al.

[11] Patent Number: 6,132,247

[45] Date of Patent: Oct. 17, 2000

[54] METALLIC ONE-PIECE HOLD-DOWN AND AN ELECTRICAL CONNECTOR WITH THE HOLD-DOWN

[75] Inventors: Hung-Chang Liou, Taoyuan; Wen-Yen Liu, Taicheng; Bih-Meau Chen, Taoyuan Hsien, all of Taiwan

[73] Assignee: Berg Technology, Inc., Reno, Nev.

[21] Appl. No.: 09/345,921

[22] Filed: Jul. 1, 1999

[51] Int. Cl.[7] ..... H01R 13/60; H01R 13/66; H01R 13/648; H01R 13/64; H01R 12/00

[52] U.S. Cl. ..... 439/567; 439/607; 439/572; 439/381; 439/79

[58] Field of Search ..... 439/567, 607, 439/572, 381, 79, 80, 81, 82

[56] References Cited

U.S. PATENT DOCUMENTS

| | | | |
|---|---|---|---|
| 5,108,312 | 4/1992 | Sampson | 439/607 |
| 5,228,870 | 7/1993 | Gorenc et al. | 439/567 |
| 5,336,111 | 8/1994 | Thrush et al. | 439/567 |
| 5,468,154 | 11/1995 | Yip et al. | 439/79 |
| 5,820,393 | 10/1998 | Edgley et al. | 439/181 |
| 5,827,089 | 10/1998 | Beck, Jr. | 439/567 |
| 5,899,771 | 5/1999 | Clark et al. | 439/567 |

*Primary Examiner*—Paula Bradley
*Assistant Examiner*—Edwin A. León
*Attorney, Agent, or Firm*—Perman & Green, LLP

[57] ABSTRACT

Disclosed is a one-piece hold-down for interconnecting an electrical connector and a printed circuit board, the hold-down having a trunk, a head portion, and a tail portion. The one-piece hold-down is suitable for holding an electrical connector having either a dielectric or a metallic housing to the printed circuit board. After the hold-down is fitted into a locating hole formed on the electrical connector, the head portion of the hold-down is deformed by means of an assembly apparatus so as to latch the electrical connector housing.

13 Claims, 3 Drawing Sheets

METALLIC ONE-PIECE HOLD-DOWN AND AN ELECTRICAL CONNECTOR WITH THE HOLD-DOWN

FIELD OF INVENTION

This invention is related to a hold-down for an electrical connector, in particular to a metallic one-piece hold-down for interconnecting an electrical connector and a printed circuit board.

BACKGROUND OF INVENTION

Generally, a typical electrical connector includes a dielectric or a metallic housing on which a plurality of conductive terminals or contacts are mounted. The terminals may be adapted for mating with terminals of a complementary connector or other connecting device, or terminated to discrete electrical wires or to conductive circuit traces on a printed circuit board (PCB). In the latter instance, the terminals typically have solder tails projective from the electrical connector housing of solder connection to the circuit traces on the PCB.

Hold-downs are generally used to interconnect electrical connectors to other electrical connectors or PCBs. The type of hold-down used depends on the type of electrical connection being formed between components. Hold-downs are fitted into locating holes in the PCB to minimize lateral (X & Y plane) movement relative to the interconnection. Hold-downs may also resist unwanted vertical (Z plane) movement such as from mating and unmating forces.

Known hold-downs range from mounting posts or pegs integrally molded with the electrical connector housing, such as posts and pegs, to discrete or independent mounting members or boards locks, such as rivets and nut & bolt combination as those disclosed in U.S. Pat. Nos. 4,679,883, 5,083,926, 5,108,308, 5,108,312, 5,137,454, 5,441,423, and 5,460,543. Some problems with these types of hold-downs include that they all require valuable "real estate" in providing the interconnections, and that some are composed of two or more components and thus complicate assembly processes and increase assembly cost.

Still further, it is typical that these hold-downs are made of plastic material. The relatively lower rigidity of plastic materials as compared with metallic materials may easily result in failure of the hold-downs due to unwanted vertical movement from mating and unmating forces.

The invention is directed to providing a one-piece hold-down at a lower manufacturing cost, wherein the one-piece hold-down greatly reduces amount of space required on a PCB for mounting the electrical connector.

SUMMARY OF INVENTION

It is an object of the invention to provide a metallic hold-down at a lower manufacturing cost than conventional hold-downs.

It is another object of the invention to provide a metallic hold-down that is suitable for holding an electrical connector having either a metallic or a plastic housing to a PCB.

It is a further object of the invention to provide an electrical connector for mounting on a PCB, with the electrical connector including new and improved metallic hold-downs.

In an exemplary embodiment of the invention, the metallic one-piece hold-down for interconnecting an electrical connector and a PCB, includes a trunk, a head portion, and a tail portion, wherein the trunk is dimensioned to fit into a first locating hole formed on a housing of the electrical connector, and the tail portion is dimensioned to interference-fit into a second locating hole formed on the PCB. As a consequence, the head portion is deformed by means of an assembly apparatus so as to latch the electrical connector housing.

The advantages and features of this invention can be easily comprehended by persons skilled in the art in accompany with the drawings and detailed explanations.

DETAILED DESCRIPTIONS OF EMBODIMENTS

Figure 1:
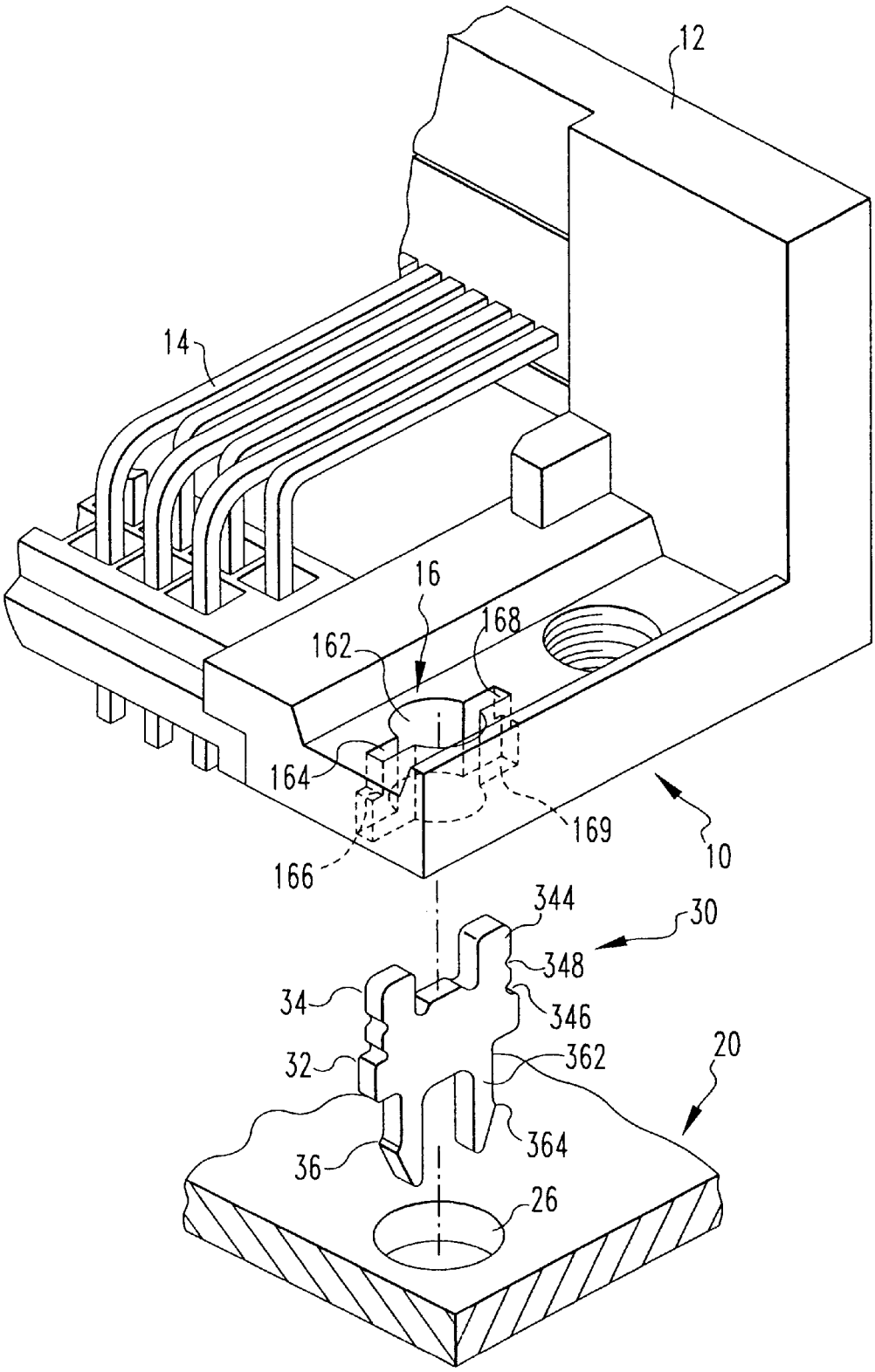
FIG. 1 is an partial exploded view showing interconnection of an electrical and a printed circuit board via a hold-down of this invention.
Figure 2:
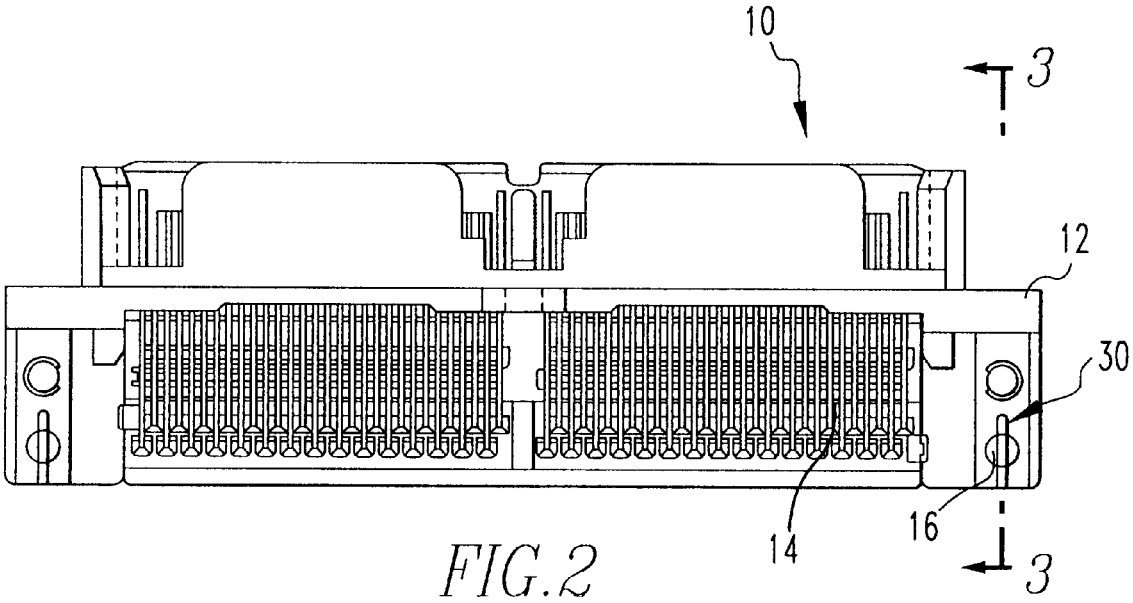
FIG. 2 shows a top plan view of an electrical with a hold-down of this invention.

Referring to FIG. 1, there is depicted therein interconnection of an electrical connector 10 and a printed circuit board (PCB) 20 via a hold-down 30 of this invention.

As shown in FIG. 1, the electrical connector 10 includes a dielectric or a metallic housing 12 on which a plurality of conductive terminals or contacts 14 are mounted. In this embodiment, the terminals 14 may subsequently be terminated to conductive circuit traces (not shown) on the PCB 20. The electrical connector housing 12 is formed with at least one first locating hole 16 that is a combination of a circular aperture 162 and a slit 164 running across and formed at opposite sides of the circular aperture 162. It is preferred that the slit 164 is a combination of an upper cell 168 and a lower cell 169 each having a predetermined depth, wherein the upper cell 168 has a length that is slightly smaller than a length of the lower cell 169 so as to form shoulders 166 at locations which the upper cell 168 and the lower cell 169 join. Functions of the shoulder 166 will be described later.

The PCB 20 is formed with at least one second locating hole 26 to be aligned with the first locating hole 16 upon assembling the electrical connector 10 to the PCB 20.

As shown in FIG. 1, the metallic one-piece hold-down 30 for interconnecting the electrical connector 10 and the PCB 20 comprises: a trunk 32 having a top edge and a bottom edge, a head portion 34 extending from the top edge of the trunk 32, and a tail portion 36 extending from the bottom edge of the trunk 32 in a direction opposing the head portion 34.

In this embodiment, the trunk 32 and the head portion 34 are dimensioned to fit into the slit 164 of the first locating hole 16. The trunk 32 is preferably dimensioned to be accommodated to the depth and the width of the lower cell 169 of the slit 164. The head portion 34 includes two ears 344 extending from the trunk 32 and being dimensioned to expose above the slit 164 after being fitted into the first locating hole 16 and adapted to the length of the upper cell 168 of the slit 164. The hold-down 30 may also be formed with notches 346, 348 respectively at locations which the ears 344 and the trunk 32 join and at outer midway sides of the ears 344.

The tail portion 36 includes two tacks 362 extending from the bottom edge the trunk 32 and is dimensioned to interference-fit into the second locating hole 26 of the PCB 20. The tacks 362 of the tail portion 36 may each include a protrusion 364 projecting from an outer midway side of the tack 362.

To secure the hold-down 30 to the electrical connector housing 12, the hold-down 30 is first fitted into the first locating hole 16 from a bottom of the electrical connector 10; after fitting, the trunk 32 is restricted and aligned by the shoulders 166 of the slit 164 to ensure proper alignment of the hold-down 30 within the slit 164 of the first locating hole 16. The notches 346, 348 formed on the ears 344 further help to retain the trunk 32 to the shoulders 166 and the housing 12 surface, respectively.

Figure 3:
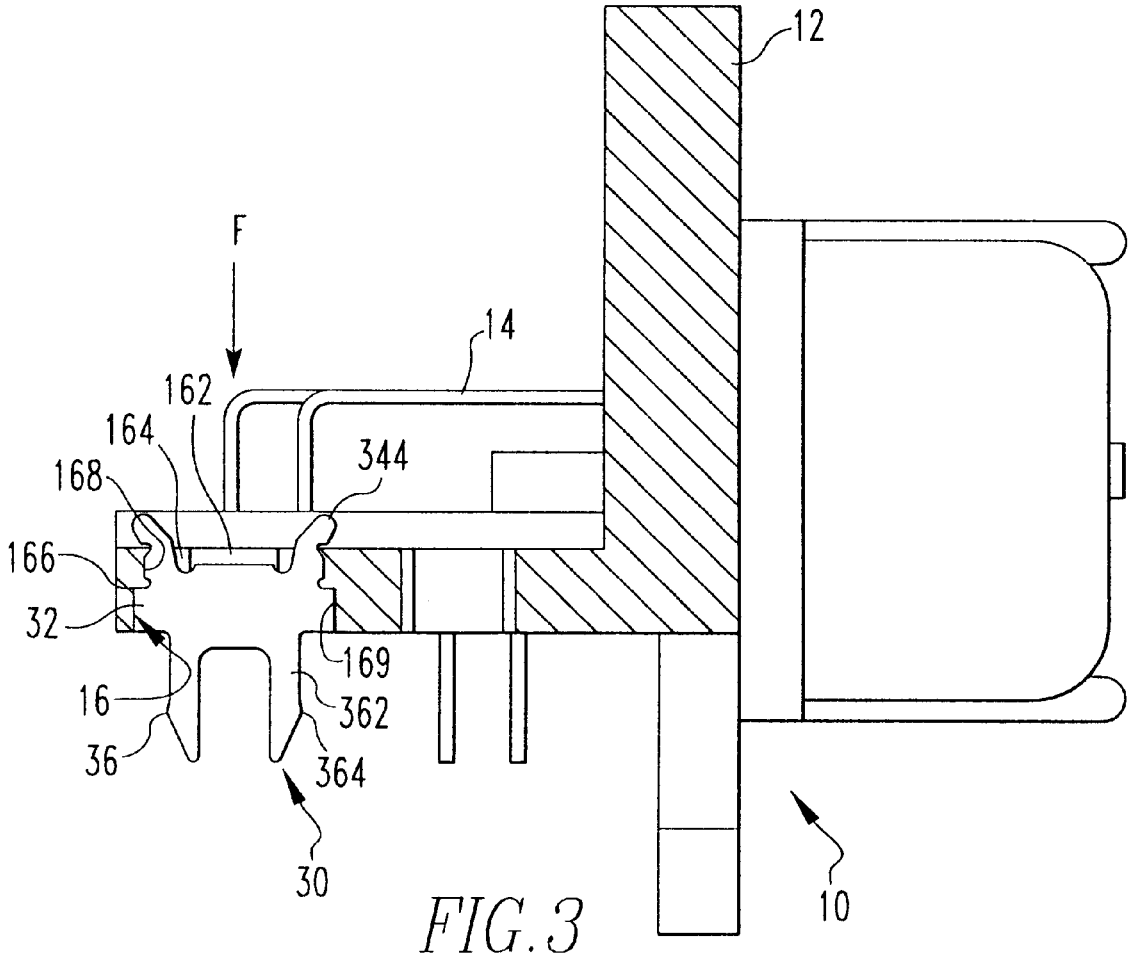
FIG. 3 is an enlarged cross-sectional view taken along lines 3—3 of FIG. 2.

After the hold-down 30 is properly aligned in the first locating hole 16, the electrical connector 10 and the hold-down 30 are then placed on an assembly apparatus (not shown). Force, in a direction depicted by an arrow F, is then applied towards the head portion 34 of the hold-down 30 causing deformation of the ears 344 towards the housing 12. As a consequence of the deformation, the ears 344 latch the electrical connector housing 12 so as to secure the hold-down 30 to the electrical connector 10, as shown in FIG. 3.

The electrical connector 10 with the hold-down 30 may be subsequently fitted into a PCB formed with at least one corresponding second locating hole 26; the protrusions 364 projecting from the tacks 362 further help to retain the hold-down 30 in the second locating hole 26.

It is known from experiences that the hold-down 30 may be stamped from phosphorous bronze or other metals having acceptable ductile characteristics.

It is worthy to note that, due to the one-piece structure of the hold-down 30 of the invention, a large batch of hold-downs 30 according to the invention can be easily stamped from metal sheets in a mass-production manner. Furthermore, the hold-down 30 of this invention is able to sustain a higher degree of forces from mating and unmating operations and is, thus, suitable for holding an electrical connector having either a metallic or a plastic housing to a PCB.

Furthermore, the hold-down 30 of this invention is assembled to the electrical connector by means of simple processes which do not require a great deal of manual assembling operations due to its minimum number of component.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A metallic one-piece hold-down for interconnecting an electrical connector having a housing and a printed circuit board, the housing being formed with at least one first locating hole and the printed circuit board being formed with at least one second locating hole corresponding to the first locating hole, the hold-down comprising:

a trunk having a top edge and a bottom edge;

a head portion extending from the top edge of the trunk and being dimensioned to fit into and to be exposed above the first locating hole after fitting the head portion into the first locating hole, wherein the head portion is sized and shaped to be deformed, after fitting of the head portion into the first locating hole, the head portion includes two ears extending from the top edge of the trunk, and the hold-down is formed with notches at locations which the ears and the trunk join and at outer midway sides of the ears to locate at least one section of the head portion over a section of the housing to thereby latch the hold-down to the housing; and a tail portion extending from the bottom edge of the trunk in a direction opposing the head portion and being dimensioned to interference-fit into the second locating hole.

2. The metallic one-piece hold-down of claim 1, wherein the hold-down is stamped from a metal sheet.

3. The metallic one-piece hold-down of claim 1, wherein the tail portion includes two tacks extending from the bottom edge of the trunk.

4. The metallic one-piece hold-down of claim 3, wherein the tacks each include a protrusion projecting from an outer midway side of the tack.

5. An electrical connector with one-piece hold-downs, the electrical connector having a housing that is formed with first locating holes and on which a plurality of conductive terminals are mounted, wherein the hold-downs are each provided to interconnect the electrical connector and a printed circuit board being formed with second locating holes corresponding to the first locating holes, characterized in that, the one-piece hold-downs each comprise:

a trunk having a top edge and a bottom edge;

a head portion extending from the top edge of the trunk, the head portion being fit into and exposed above the first locating hole, wherein the head portion is deformed to latch to the electrical connector housing after the head portion is fit into the first locating hole, the head portion includes two ears extending from the trunk, and the hold-down is formed with notches at locations which the ears and the trunk join and at outer midway sides of the ears; and a tail portion extending from the bottom edge of the trunk in a direction opposing the head portion and being dimensioned to interference-fit into the second locating hole.

6. The electrical connector of claim 5, wherein the hold-down is stamped from a metal sheet.

7. The electrical connector of claim 5, wherein the first locating holes are each a combination of a circular aperture and a slit running across the circular aperture, in which the slit is a combination of an upper cell and a lower cell each having a pre-determined depth, the upper cell has a length that is slightly smaller than a length of the lower cell so as to form shoulders at locations which the upper cell and the lower cell join.

8. The electrical connector of claim 7, wherein the trunk is dimensioned to be accommodated to the depth and the width of the lower cell of the slit and the ears are dimensioned to be adapted to the length of the upper cell of the slit.

9. The electrical connector of claim 5, wherein the tail portion includes two tacks extending from the bottom edge of the trunk.

10. The electrical connector of claim 9, wherein the tacks each include a protrusion projecting from an outer midway side of the tack.

11. An electrical connector comprising:

a housing;

electrical contacts connected to the housing; and at least one one-piece hold-down connected to the housing for connecting the housing to an electrical component, the hold-down comprising:

a first section for fixedly connecting the hold-down to the electrical component, and a second section connected to the first section, the second section extending through and out of a hole in the housing and having ears which are permanently deformed in an outward direction relative to each other, after the ears are passed through the hole, such that the outwardly deformed ears are latched behind a portion of the housing, the hold-down is formed with notches at locations which the ears and the trunk join and at outer midway sides of the ears.

12. An electrical connector as in claim 11 wherein the housing comprises at least one shoulder in the hole and the hold-down comprises at least one surface which contact the shoulder to stop insertion of the hold-down through the hole.

13. An electrical connector as in claim 12 wherein the at least one surface is located opposite the ears after the ears are outwardly deformed.

* * * * *